US006960090B2

(12) United States Patent
Denter et al.

(10) Patent No.: US 6,960,090 B2
(45) Date of Patent: Nov. 1, 2005

(54) PLUG CONNECTOR ARRANGEMENT WITH LATCHING ACTUATION SLIDE MEANS

(75) Inventors: Susanne Denter, Bruchkoebel (DE); Konrad Roth, Fraenkisch-Crumbach (DE); Georg Puckel, Obertshausen/Hausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 150 days.

(21) Appl. No.: 10/620,779

(22) Filed: Jul. 16, 2003

(65) Prior Publication Data

US 2005/0020114 A1 Jan. 27, 2005

(30) Foreign Application Priority Data

Aug. 7, 2002 (EP) ..... 02017808

(51) Int. Cl.[7] ..... H01R 13/62
(52) U.S. Cl. ..... 439/157; 439/372
(58) Field of Search ..... 439/489, 488, 439/157, 372, 152, 153, 347

(56) References Cited

U.S. PATENT DOCUMENTS

| | | | | |
|---|---|---|---|---|
| 5,618,194 A | | 4/1997 | Maue et al. | 439/157 |
| 5,660,556 A | | 8/1997 | Badaroux et al. | 439/310 |
| 6,244,880 B1 | * | 6/2001 | Fukase et al. | 439/157 |
| 6,254,407 B1 | * | 7/2001 | Burns | 439/157 |
| 6,345,995 B1 | * | 2/2002 | Bigotto et al. | 439/157 |
| 6,361,356 B1 | * | 3/2002 | Heberlein et al. | 439/489 |
| 2001/0019908 A1 | * | 9/2001 | Zweigle | 439/157 |

FOREIGN PATENT DOCUMENTS

| | | | |
|---|---|---|---|
| EP | 0273999 | 7/1988 | H01R/13/529 |
| EP | 0 273 999 B1 | 9/1993 | H01R/13/629 |
| EP | 0945928 A2 * | 9/1999 | |
| EP | 0945928 | 9/1999 | H01R/13/629 |

* cited by examiner

*Primary Examiner*—Hien Vu
(74) *Attorney, Agent, or Firm*—Barley Snyder LLC

(57) ABSTRACT

A plug connector arrangement has a socket housing with receptacle contacts and a plug housing with pluggable contacts. To make an electrical connection between the receptacle contacts and the pluggable contacts, at least one of the housings is movable so that it can be pushed together with the other housing. At least one actuation slide means is mounted on the movable housing and is displaceable in a direction transverse to a direction of movement of the moveable housing. The actuation slide means has at least one control element that co-operates with at least one control means arranged on the other housing such that the movable housing is actuated toward the other housing when the actuation slide means is displaced. The actuation slide means has at least one latching device that co-operates with at least one corresponding latching element on the fixed housing to hold the moveable housing in position relative to the fixed housing before actuation.

5 Claims, 5 Drawing Sheets

PLUG CONNECTOR ARRANGEMENT WITH LATCHING ACTUATION SLIDE MEANS

BACKGROUND OF THE INVENTION

The invention relates to a plug connector arrangement that includes a moveable housing, a fixed housing, and an actuation means for moving the moveable housing into engagement with the fixed housing.

DESCRIPTION OF THE PRIOR ART

Plug connector arrangements typically have a plug housing, a socket housing, and an actuation means for moving one of the housings into engagement with the other housing such that receptacle contacts of the socket housing are electrically connected to pluggable contacts of the plug housing. These types of plug connector arrangements are primarily used in cases where one of the housings is fixed and accessibility to the plug connector arrangement is limited. These types of conditions typically exist, for example, in the automotive sector. In order to save space, the moveable housing is formed so that only a small portion of the moveable housing projects from the fixed housing when the housings are engaged. This configuration causes the disengagement of the moveable housing from the fixed housing to be difficult. A problem also exists in that the plug connector arrangement has a large number of contact elements that exert a high normal contact force such that considerable force is required to plug-in and release the moveable housing from the fixed housing.

In order to resolve these problems, plug connector arrangements have been provided with actuation slide means. The actuation slide means is arranged on the movable housing and is displaceable in a direction transverse to a direction of engagement. For example, the moveable housing may be provided with sloping control grooves that engage with cam projections on the fixed housing. Movement of the movable housing toward the fixed housing can be performed by displacement of the actuation slide means transversely with respect to the direction of the movement of the moveable housing toward the fixed housing. In another example, an actuation slide means is constructed as a toothed rack wherein the displacement of the moveable housing is forced by rotary movement of a pivotal lever with a pinion region engaging in the toothed rack. Examples of such actuation slide means are taught by European Patent No. 0 273 999 B1and U.S. Pat. Nos. 5,618,194 and 5,660,556.

These plug connector arrangements, however, have the disadvantage that before being pushed together the two plug connector housings have to be manually held in position until the actuation slide means is displaced so that the pre-positioned fixed and moveable housings do not come apart in an uncontrolled manner. This is particularly disadvantageous if the movable housing is to be pushed into a fixed housing mounted overhead, for example, in a ceiling of a vehicle. Additionally, when the fixed housing is mounted overhead, the movable housing has to be manually prevented from falling when released from engagement with the fixed housing.

It is therefore desirable to develop a plug connector arrangement which can be pushed together and released in a simplified and secured manner while at the same time maintaining low manufacturing costs and saving space.

SUMMARY OF THE INVENTION

This and other objects are solved by a plug connector arrangement having a fixed housing, a moveable housing, and an actuation device. The fixed housing has a latching element and a control means. The moveable housing has an actuation slide means. The actuation slide means has a control element that co-operates with the control means to actuate the moveable housing toward the fixed housing and into engagement therewith. A latching device, which co-operates with the latching element, holds the moveable housing in position relative to the fixed housing before actuation.

DETAILED DESCRIPTION OF THE PREFERRED EMBODIMENT

Figure 1:
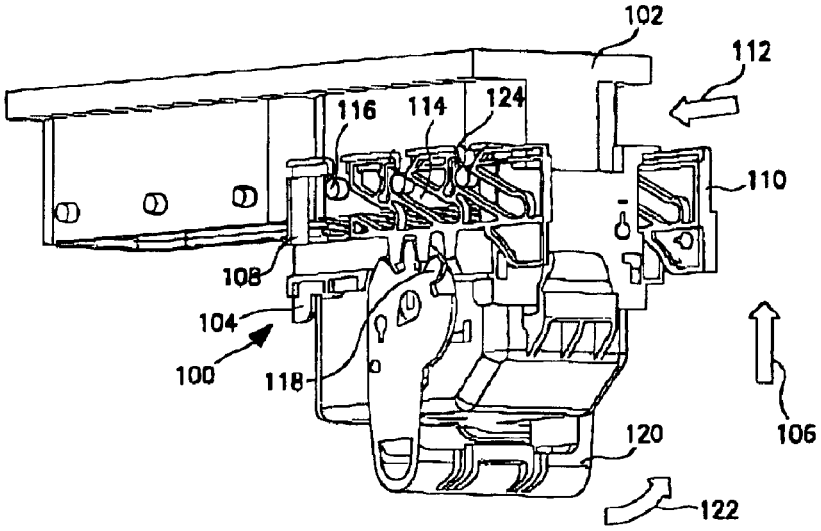
FIG. 1 is a perspective view of a plug connector arrangement according to the invention with the plug connector arrangement partially opened-up.
Figure 3:
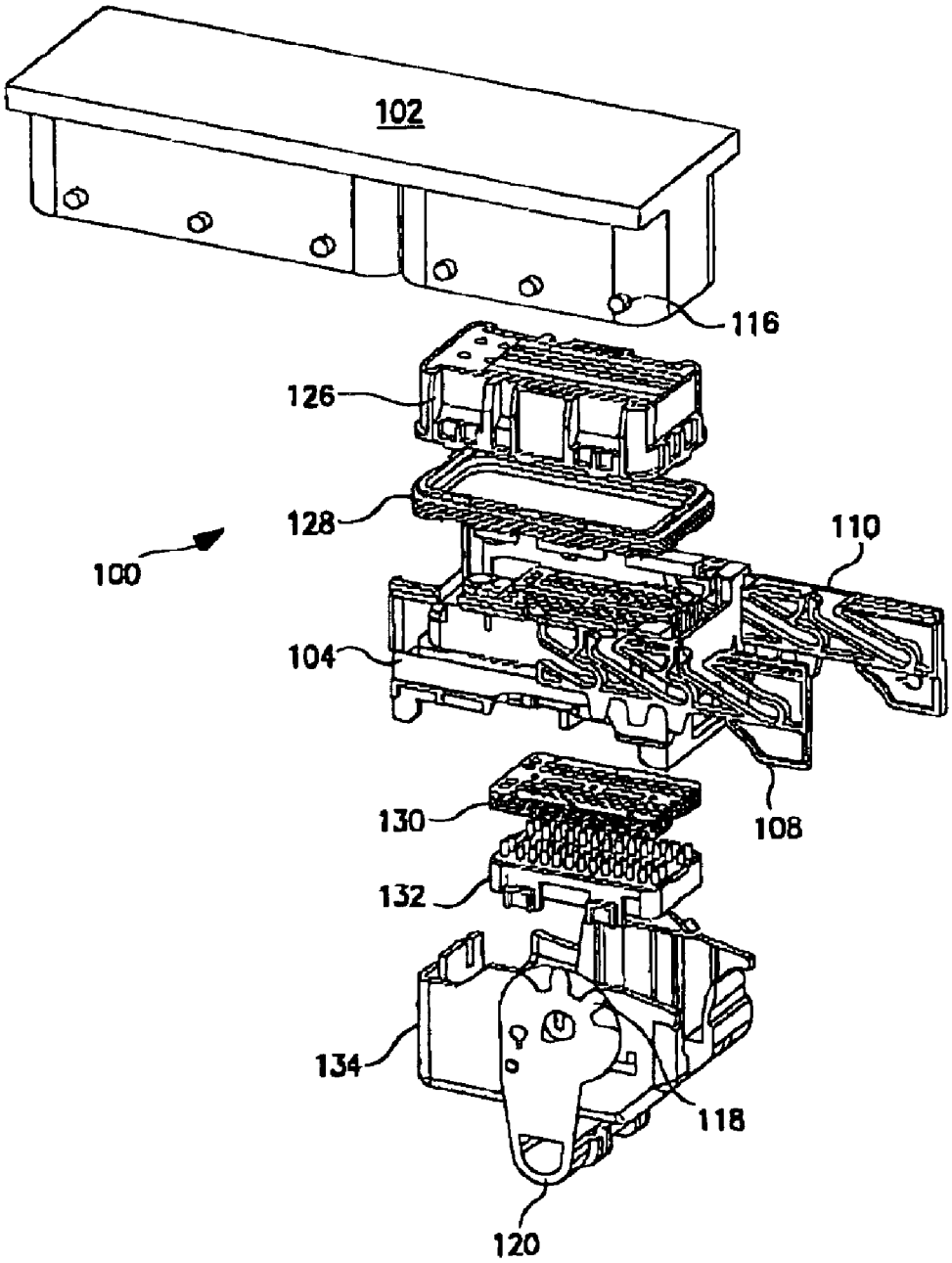
FIG. 3 is an exploded view of the plug connector arrangement of FIG. 1.

FIG. 1 shows an example of an embodiment of a plug connector arrangement 100 according to the invention. As best shown in FIG. 3, the plug connector arrangement 100 has a fixed housing 102. In the embodiment illustrated, the fixed housing 102 is a plug housing, however, the fixed housing 102 may alternatively be moveable. The fixed housing 102 mounts the plug connector arrangement 100 overhead such as in a ceiling of a motor vehicle. The fixed housing 102 has an outside surface provided with cam projections 116 that also act as latching elements. A contact housing 126 provided with contact pins (not shown) is received in the fixed housing 102. A first seal 128 is positioned adjacent to the contact housing 126 for sealing the two housings when the plug connector arrangement 100 is fully engaged.

Figure 4:
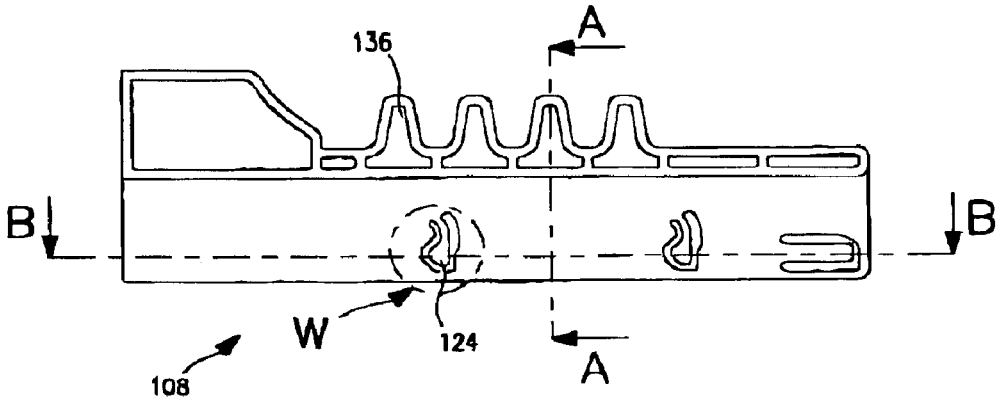
FIG. 4 is a first side view of an actuation slide means.
Figure 5:
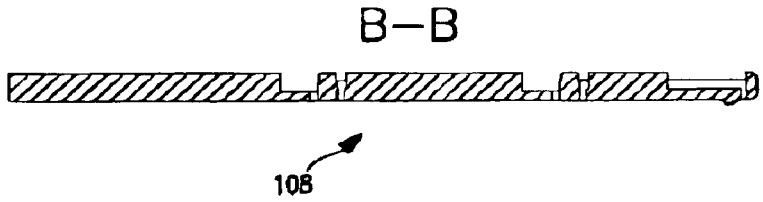
FIG. 5 is a sectional view taken along line B—B of FIG. 4.
Figure 6:
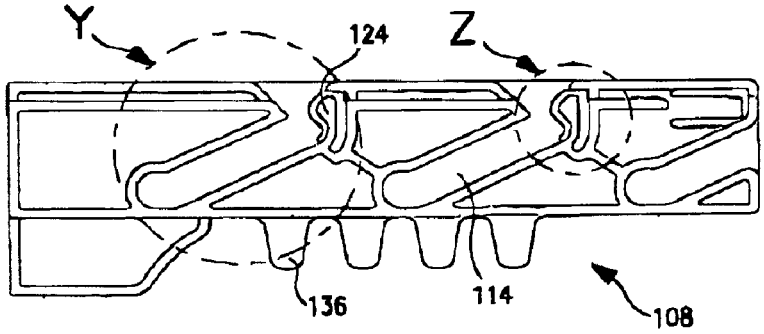
FIG. 6 is a second side view of the actuation slide means of FIG. 4.
Figure 7:
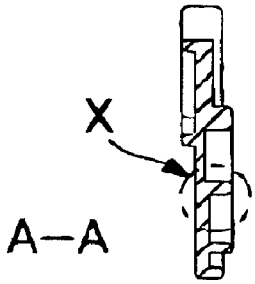
FIG. 7 is a sectional view taken along line A—A of FIG. 4.
Figure 8:
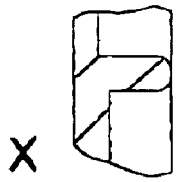
FIG. 8 is an enlarged view of area X of FIG. 7.
Figure 9:
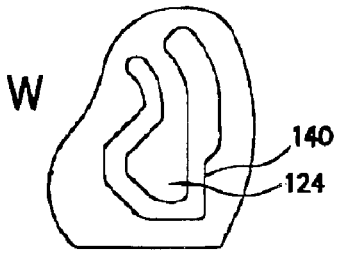
FIG. 9 is an enlarged view of area W of FIG. 4.
Figure 10:
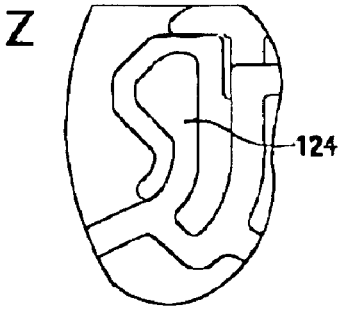
FIG. 10 is an enlarged view of area Z of FIG. 6.
Figure 11:
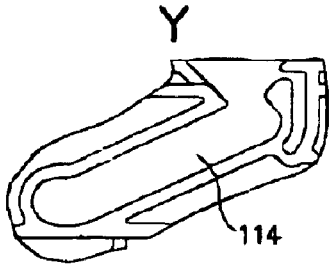
FIG. 11 is an enlarged view of area Y of FIG. 6.
Figure 12:
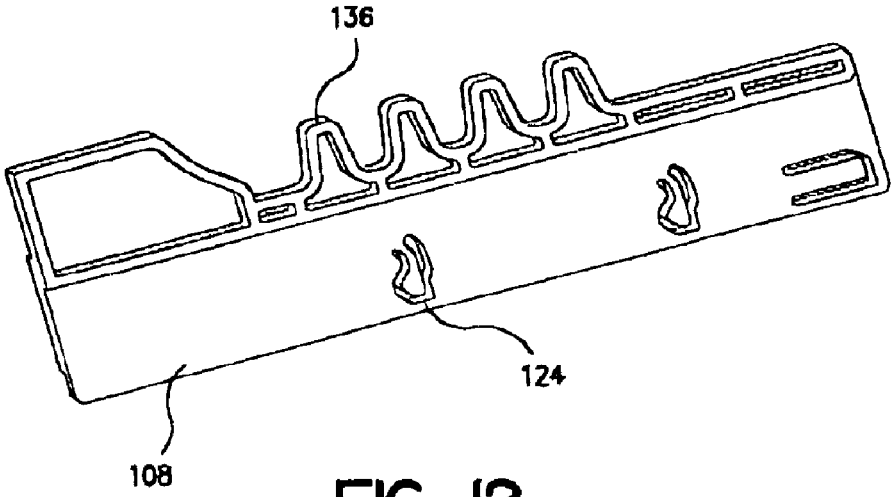
FIG. 12 is a perspective view of the actuation slide means of FIG. 4.
Figure 13:
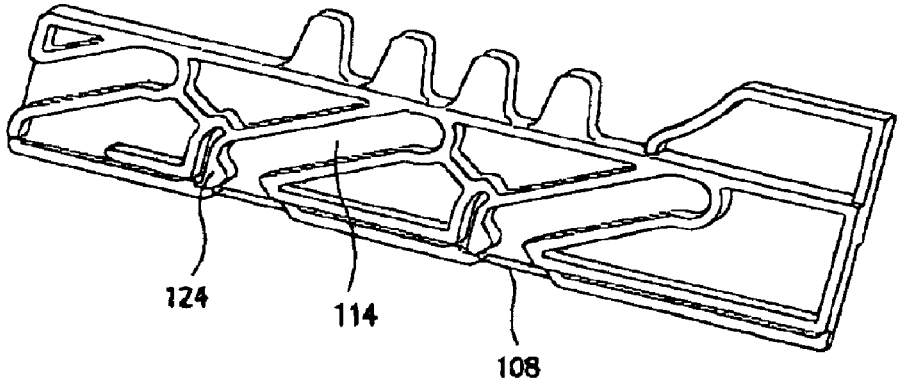
FIG. 13 is a perspective view of the actuation slide means of FIG. 6.

A movable housing 104 receives the contact housing 126. In the embodiment illustrated, the movable housing 104 is a socket-type plug, however, the socket-type plug may also be fixed. The movable housing 104 has two actuation slide means 108, 110 with toothed racks 136, as shown in FIG. 4. The actuation slide means 110 is of a construction that has mirror symmetry with respect to the actuation slide means 108 illustrated herein. As best shown in FIGS. 4 through 13, the actuation slide means 108 has a control element constructed as a ramp-like groove 114. A web integrally formed on a thin outer skin forms the ramp-like groove 114. Each of the ramp-like grooves 114 is arranged to correspond to the cam projections 116 of the fixed housing 102. Although the ramp-like grooves 114 ensure a high level of stability for the actuation slide means 108, 110, alternatively, the grooves 114 may be constructed as through-apertures. As best shown in FIGS. 9 and 10, integrally formed in an introduction region of the ramp-like grooves 114 is a latching device in the form of a resilient latching hook 124. The latching hook 124 is integrally formed on a free end of a projecting cut-out spring arm. An abutment projection 140 is arranged adjacent to the latching hook 124 to prevent the latching hook 124 from resiling too far.

As shown in FIG. 3, the moveable housing 104 has a cover 134 provided with a pivotal lever 120. The pivotal lever 120 has pinion means 118 corresponding to the toothed racks 136 for moving the actuation slide means 108, 110. A second seal 130 and associated cover 132 for the second seal 130 are provided between the cover 134 and the movable housing 104.

Figure 2:
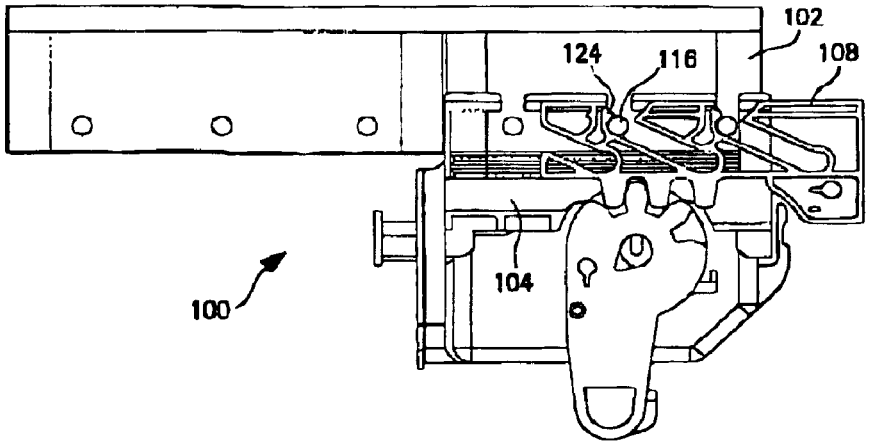
FIG. 2 is a side view of the plug connector arrangement of FIG. 1.

The operation of the plug connector arrangement 100 will now be described in greater detail with reference to FIGS. 1 and 2. FIGS. 1 and 2 shows the position of the plug connector arrangement 100 before the moveable housing 104 is engaged with the fixed housing 102. To push the moveable housing 104 into engagement with the fixed housing 102 to create an electrical connection, the pivotal lever 120 is rotated in a direction 122, as shown in FIG. 1. As a result of the transmission of forces between the pinion region 118 and the toothed rack 136, displacement of the actuation slide means 108, 110 occurs in a direction 112, which is transverse to a direction 106 of movement of the moveable housing 104. The movable housing 104 is securely guided in the direction 106 as the actuation slide means 108, 110 is displaced in the direction 112 via the grooves 114 by the cam projections 116.

So that the movable housing 104 is held in a pre-latched position before the actuation slide means 108, 110 is displaced, the latching hooks 124 latch onto the cam projections 116 that are positioned in the respective grooves 114, as best shown in FIG. 2. The latching hooks 124 hold the movable housing 104 both before engagement with the fixed housing 102 and after engagement with the fixed housing 102 so that the moveable housing 104 does not need to be manually held to prevent the moveable housing 104 from falling-out in an uncontrolled manner.

The invention described herein has the latching hooks 124 integrally formed on the actuation slide means 108, 110 such that the movable housing 104 is secured to the fixed housing 102 before the actuation slide means 108, 110 is actuated. Thus, when the fixed housing 102 is mounted overhead, it is possible to prevent the separation of the movable housing 104 from the fixed housing 102 in an uncontrolled manner during either mounting or dismounting of the plug connector arrangement 100. Because the latching hooks 124 are integrally formed on the actuation slide means 108, 110, which may be manufactured separately from the other elements of the plug connector arrangement 100, and the latching hooks 124 engage cam projections 116 already needed to guide the movable housing 104, any plug connector arrangement may be retro-fit with a latching mechanism according to the invention simply by replacing the actuation slide means 108, 110. Thus, considerable manufacturing costs can be saved and a high level of flexibility attained. The latching hooks 124 are also structurally simple to form and inexpensive to make.

The force required to engage and release the moveable housing 104 with the fixed housing 102 is kept small while providing secure latching, because the latching hook 124 is movable substantially parallel to a direction of displacement of the actuation slide means 108, 110. Further, displaceability may be attained for the latching hook 124 by structural means, in that the latching hook 124 is integrally formed on the resilient cut-out spring arm. Because the latching hook 124 is arranged in an introduction region of the grooves 114, no additional introduction openings for the latching hooks 124 have to be provided.

The arrangement of the cam projections 116 and the grooves 114 offers the advantage that there is precise relative guidance between the fixed housing 102 and the moveable housing 104 when pushed together. Thus, the possibility that contact pins or sleeves are damaged when the connection is pushed together or released is largely eliminated. Further, if the control device of the actuation slide means 108, 110 is made as ramp-like grooves 114, a higher level of mechanical stability of the actuation slide means 108, 110 can be achieved. If, on the other hand, the grooves 114 are formed as continuous openings in the wall of the actuation slide means 108, 110, this arrangement offers the advantage that simplified manufacture of the actuation slide means 108, 110, typically made as an injection molded part of synthetic material, is possible.

A particularly convenient and secure way of moving the actuation slide means 108, 110 is for the actuation slide means 108, 110 to be constructed as the toothed rack 136 such that the pinion region 118 of the pivotal lever 120 engages the toothed rack 136 to displace the actuation slide means 108, 110. Further, the moveable and fixed housings 102, 104 can be prevented from twisting when actuation is performed if the actuation slide means 108, 110 is formed by two elements of mirror-symmetrical construction which are separated from one another.

We claim:

1. A plug connector arrangement, comprising:

a fixed housing having cam projections;

a moveable housing having two actuation slide means, each of the actuation slide means having ramp-like grooves that receive the cam projections to actuate the moveable housing toward the fixed housing and into engagement therewith, each of the actuation slide means having a toothed rack with which a pinion region of a pivotal lever engages in order to displace the actuation slide means, the at least two actuation slide means being of mirror-symmetrical construction and being displaceable in the same direction; and resilient latching hooks integrally formed with the actuation slide means on free ends of cut-out spring arms, the resilient latching hooks being arranged at an introductory region of the ramp-like grooves and projecting into the ramp-like grooves, the resilient latching hooks co-operating with the cam projections to hold the moveable housing in position relative to the fixed housing before actuation wherein the resilient hooks and the introductory region of the ramp-like grooves are positioned opposite with the toothed racks.

2. The plug connector arrangement of claim 1, wherein each of the ramp-like grooves is formed as a web integrally formed on a surface of the actuation slide means.

3. The plug connector arrangement of claim 1, wherein the actuation slide means are displaceable in a direction transverse to a direction of movement of the moveable housing toward the fixed housing.

4. The plug connector arrangement of claim 3, wherein the resilient latching hooks are movable substantially parallel to the direction of displacement of the actuation slide means.

5. The plug connector arrangement of claim 1, wherein the moveable housing is a socket housing having receptacle contacts and the fixed housing is a plug housing having pluggable contacts.

* * * * *